US005185493A

United States Patent [19]

Isgen

[11] Patent Number: 5,185,493

[45] Date of Patent: Feb. 9, 1993

[54] LOADING APPARATUS FOR MANUAL INSERTION OF AMMUNITION

[75] Inventor: Helmut Isgen, Willich, Fed. Rep. of Germany

[73] Assignee: Rheinmetall GmbH, Düsseldorf, Fed. Rep. of Germany

[21] Appl. No.: 859,978

[22] Filed: Mar. 30, 1992

[30] Foreign Application Priority Data

Apr. 24, 1991 [DE] Fed. Rep. of Germany ..... 4113341

[51] Int. Cl.[5] ..... F41A 9/52

[52] U.S. Cl. ..... 89/45

[58] Field of Search ..... 89/24, 26, 45

[56] References Cited

U.S. PATENT DOCUMENTS 2,851,928 9/1958 Hultgren et al. ..... 89/45

*Primary Examiner*—Stephen C. Bentley

*Attorney, Agent, or Firm*—Spencer, Frank & Schneider

[57] ABSTRACT

An apparatus for manually loading ammunition into one end of a gun tube includes a lift-type breechblock wedge operatively arranged for sealing and unsealing the one end of the gun tube. The breechblock wedge has an underside including at least two lateral guide strips attached thereto, a recess for receiving one end of a locking member and a pin having an enlarged head that projects from the underside. An ammunition loading tray is disposed at the one end of the gun tube for insertion of ammunition into the gun tube. The tray has at least two lateral ribs operatively arranged for sliding engagement with the guide strips. One of the lateral ribs includes an elongated opening which extends in the axial direction of the gun tube. The elongated opening has a first portion, axially adjacent the gun tube through which the pin head can be pushed, and a second portion, axially remote from the gun tube, for receiving the pin. The one rib further includes a displaceable locking member. The locking member is positioned on the one rib for displacement into the recess in the breechblock wedge when the pin abuts an end region of the second portion of the elongated opening.

5 Claims, 3 Drawing Sheets

5
6
7
8
1a
3
9
4
10
1
2

FIG.2
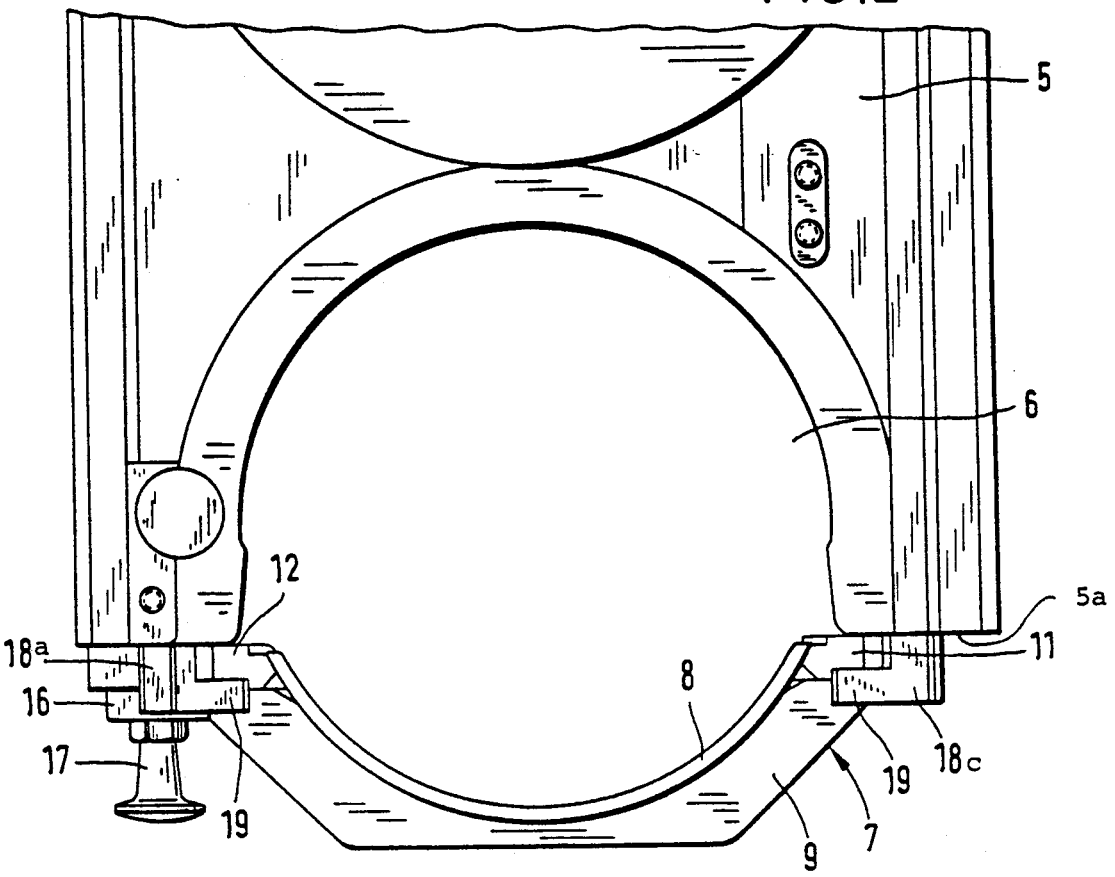
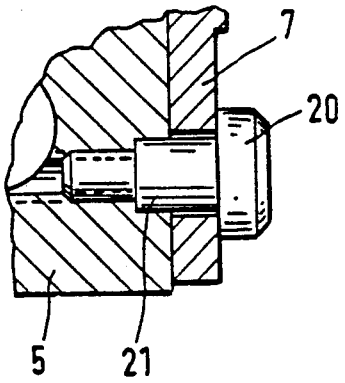
FIG.4
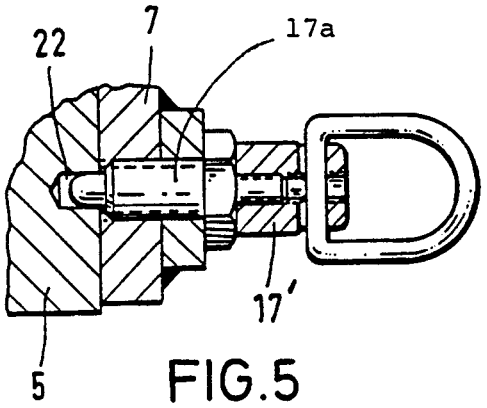
FIG.5

LOADING APPARATUS FOR MANUAL INSERTION OF AMMUNITION

BACKGROUND OF THE INVENTION

The present invention relates to the field of manual ammunition loading devices and, more particularly, to an apparatus which facilitates the manual insertion of ammunition into an automatically loadable gun having an obturator at one end of a gun tube which employs a lift-type breechblock wedge as a means of sealing that end of the gun tube following insertion of ammunition.

In connection with automatically loaded guns of this type, it is known to employ an auxiliary loading tray for the emergency insertion of ammunition if there is a malfunction or failure of the automatic loading device or if there is no on-board power. Such an auxiliary loading tray must be attached as quickly as possible so that, for the sake of internal safety, the firing operation can be continued without undue loss of time.

SUMMARY OF THE INVENTION

Accordingly, it is an object of the present invention to provide a loading apparatus for the manual insertion of ammunition into a gun of the type previously described which permits uncomplicated emergency operation, safe and simple manipulation, fast firing cadence for the weapon as well as low weight and good stowability of the loading apparatus.

The above and other objects are accomplished in accordance with the invention by the provision of an apparatus for manually loading ammunition into one end of a gun tube, including: a lift-type breechblock wedge operatively arranged to seal and unseal the one end of the gun tube, the lift-type breechblock wedge having an underside with at least two lateral guide strips attached thereto, a recess for receiving one end of a locking member, and a pin having an enlarged head projecting from the underside; an ammunition loading tray having at least two lateral ribs operatively arranged for sliding engagement with the guide strips on the underside of the breechblock wedge, one of the lateral ribs including a elongated opening extending in the axial direction of the gun tube, the elongated opening having a first portion axially adjacent the gun tube through which the pin head can be pushed, and a second portion axially remote from the gun tube for receiving the pin; the one lateral rib also including a displaceable locking member positioned on the one rib for displacement into the recess of the breechblock wedge when the pin abuts an end region of the second portion of the elongated opening in the one lateral rib.

According to a further feature of the present invention, the ammunition loading tray for manual loading is arrested at the breechblock wedge by means of a quick-action lock and it remains at the breechblock wedge during firing operation. The loading tray can simultaneously be employed as a protection for the obturator ring and the breechblock when the projectile is loaded manually.

DESCRIPTION OF THE DRAWINGS

Further features of the invention can be found in the detailed description below taken in conjunction with the drawings, wherein:

FIG. 2 is a frontal view of the loading apparatus of FIG. 1 seen from the gun tube;

FIG. 4 is a sectional view along line IV—IV of FIG. 3; and

FIG. 5 shows a further embodiment of a locking component that could be used in the apparatus of FIG. 1.

DETAILED DESCRIPTION OF THE INVENTION

Figure 1:
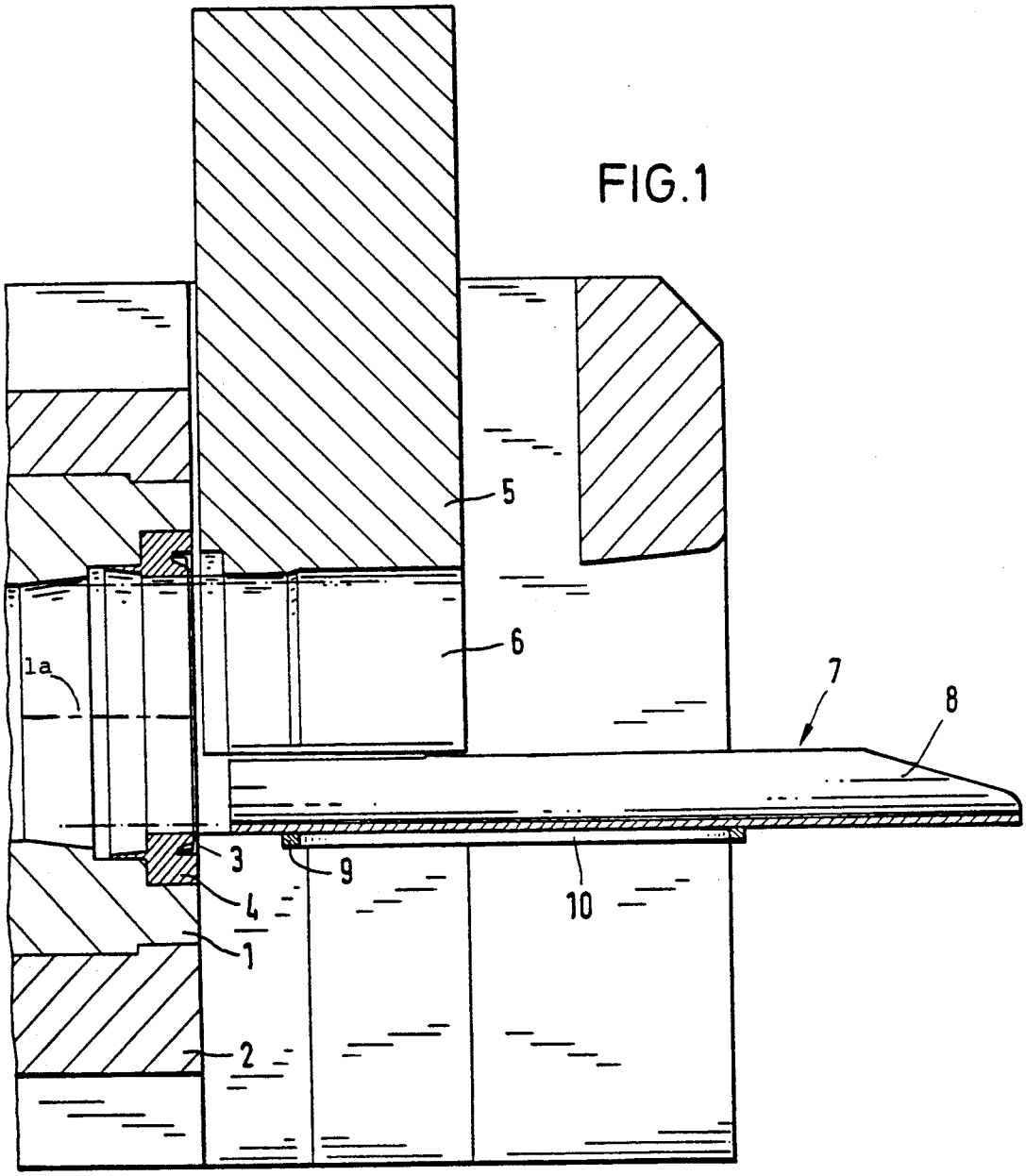
FIG. 1 is a longitudinal sectional view of a loading apparatus in accordance with the invention.

FIG. 1 is a sectional view of the ammunition loading end of a gun tube 1 that can be loaded by means of an automatic loading device (not shown). Gun tube 1 has an axis 1*a* and is provided with a breech ring 2 on the exterior and a breech ring 4 equipped with an obturator ring 3 on the interior. An appropriately movable lift-type breechblock wedge 5 equipped with an ammunition passage opening 6 is shown closed on its underside 5*a* (see also FIG. 2) for emergency operation by an auxiliary ammunition loading tray 7.

Figure 3:
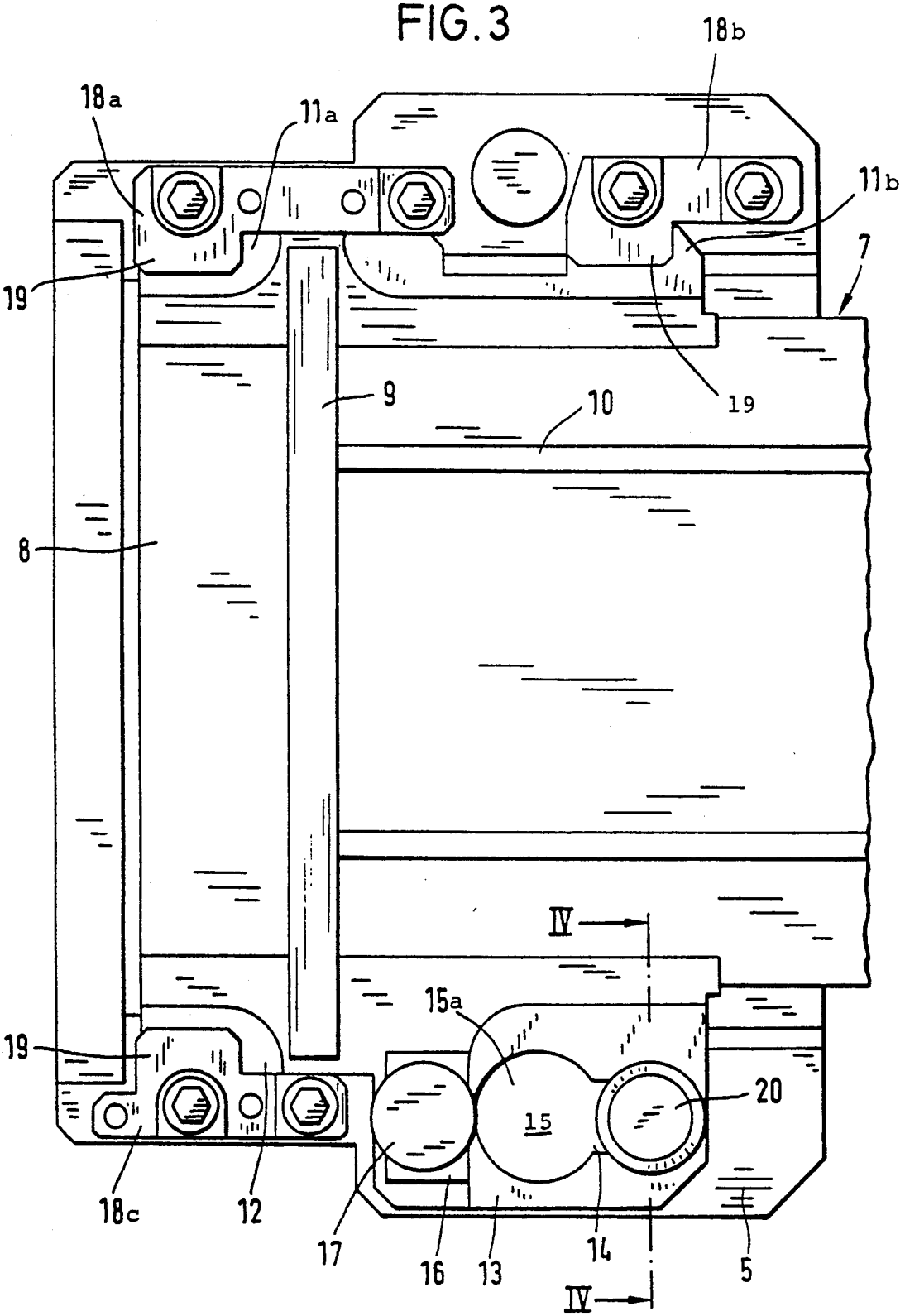
FIG. 3 is a bottom view of the loading apparatus of FIG. 1 without the gun tube.

Auxiliary ammunition loading tray 7 includes a tray body 8 for accommodating at least one projectile. Tray 7 is reinforced on its underside by at least one rib 9 transverse to gun tube axis 1*a* and several longitudinal ribs 10 (see also FIG. 2 and 3). As shown in FIG. 3, on the end of tray 7 facing gun tube 1 (i.e. to the left of FIG. 3) ammunition loading tray 7 is equipped on one side (the top in FIG. 3) with two axially spaced lateral ribs 11*a* and 11*b* and on the opposite side with a lateral rib 12 which has a section 13 that broadens toward the end facing away from gun tube 1. Section 13 is provided with an elongated opening 15 extending in the axial direction 1*a* of gun tube 1. Elongated opening 15 contains a first insertion portion 15*a* axially adjacent to gun tube 1 and a second portion 14 axially remote from gun tube 1 having a width smaller than the diameter of the first insertion portion 15*a*. Additionally, adjacent to first insertion portion 15*a* of the elongated opening 15, a block 16 is provided which accommodates a fast-action, displaceable locking member 17.

Ammunition loading tray 7 is removably connectable with underside 5*a* of lift-type breechblock wedge 5. For this purpose, on one side of ammunition passage opening 6 lift-type breechblock wedge 5 has two mutually spaced apart guide strips 18*a* and 18*b* suitably attached to underside 5*a* while on the other side of ammunition passage opening 6 one such guide strip 18*c* is suitably attached to underside 5*a*. Guide strips 18*a* and 18*b* are spaced radially at a distance from 18*c* corresponding to the width of ammunition loading tray 7 in the region of ribs 11*a*, 11*b* and 12 and serve to provide lateral guidance over their entire length. Additionally, at their end facing gun tube 1, guide strips 18*a*, 18*b* and 18*c* are provided with shorter lip sections 19 which are oriented toward ammunition passage opening 6 and are spaced from the under side 5*a* of lift-type breechblock wedge 5 at a distance corresponding to the thickness of ribs 11*a*, 11*b* and 12.

On the side where only one guide strip 18*c* is disposed, lift-type breechblock wedge 5 is provided at its underside 5*a* with a pin having a pin body 21 and an enlarged pin head 20 (see FIG. 4). The diameter of pin head 20 is somewhat smaller than that of the first insertion portion 15*a* of elongated opening 15 in lateral rib 12 and the diameter of pin body 21 is somewhat smaller than the width of the second portion 14 of elongated opening 15. The second portion 14 has a width sufficiently narrow to accommodate pin body 21 but not pin head 20.

In addition, lift-type breechblock wedge 5 has an opening or recess 22 on its underside for the engagement and accommodation of a free end 17*a* of fast-action (for example spring loaded), displaceable locking member 17.

For the connection of auxiliary ammunition loading tray 7 and lift-type breechblock wedge 5, auxiliary ammunition loading tray 7 is guided against underside 5*a* of lift-type breechblock wedge 5 so that pin head 20 moves through the first insertion portion 15*a* of elongated opening 15 and the lateral ribs 11*a* and 11*b* on one side and rib 12 on the opposite side come into engagement with guide strips 18*a*, 18*b* and 18*c* along sections 19. Auxiliary ammunition loading tray 7 is then advanced in the direction toward gun tube 1 until pin body 21 abuts an end region (remote from gun tube 1) of the second portion 14 of elongated opening 15. When this end region is reached, ribs 11*a*, 11*b* and 12 are disposed between underside 5*a* of lift-type breechblock wedge 5 and lip sections 19 of guide strips 18*a*, 18*b* and 18*c*, while the end of fast-action displaceable locking member 17 facing recess 22 drops into this recess or, alternatively, can be turned into recess 22 if, as shown in FIG. 5, a locking member 17' includes a pin 17*a* with an appropriate thread.

In this way, auxiliary ammunition loading tray 7 can be fastened easily and without complications to lift-type breechblock wedge 5 in the manner of a snap lock in the case of an emergency so that the continuation of firing operations is ensured. During firing operations, the tray remains at lift-type breechblock wedge 5. The parts required for fastening are small and result in only little additional weight. Moreover, auxiliary ammunition loading tray 7 has practically no projecting components and can thus be accommodated in a space saving manner.

Since, in the operating position, when lift-type breechblock wedge 5 is open, auxiliary ammunition loading tray 7 is disposed at such a height with respect to obturator 3 and the bottom of gun tube 1, and is centered (FIG. 1), obturator ring 3 and the bottom of the gun tube cannot be damaged during manual insertion of ammunition.

The space between obturator-ring and front face of auxiliary ammunition loading tray gives the possibility of a quick change of obturator ring when auxiliary ammunition loading tray is mounted.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An apparatus for manually loading ammunition into one end of a gun tube, comprising:

a lift-type breechblock wedge operatively arranged for sealing and unsealing the one end of the gun tube, said breechblock wedge having an underside including at least two lateral guide strips attached thereto, a recess for receiving one end of a locking member, and a pin having an enlarged head projecting from said underside; and an ammunition loading tray for insertion of ammunition into the one end of the gun tube, said tray having at least two lateral ribs operatively arranged for sliding engagement with said guide strips, one of said lateral ribs including an elongated opening extending in the axial direction of the gun tube, said elongated opening having a first portion, axially adjacent the gun tube, through which said pin head can be pushed and a second portion, axially remote from the gun tube, for receiving said pin, and said one rib further including a displaceable locking member positioned on said one rib for displacement into the recess in said breechblock wedge when said pin abuts an end region of the second portion of said elongated opening.

2. An apparatus as recited in claim 1, wherein said ammunition loading tray includes at least one side with at least two, axially-spaced lateral ribs.

3. An apparatus as recited in claim 2, wherein the underside of said lift-type breechblock wedge includes a portion on either side of the gun tube axis, one side portion having at least two spaced apart guide strips and the other side portion having at least one guide strip and said pin that is spaced therefrom.

4. An apparatus as recited in claim 1, wherein said lateral ribs have an underside which is supported on said guide strips.

5. An apparatus as recited in claim 1, wherein the gun tube comprises an obturator ring at the one end, said loading tray has an end facing the gun tube and, when the lift-type breechblock wedge is in an open position, said loading tray is at such a height relative to the obturator ring and bottom of the gun tube, that in operation ammunition is not damaged during insertion into the gun tube.

* * * * *